US006814634B2

(12) United States Patent
Roberts

(10) Patent No.: US 6,814,634 B2
(45) Date of Patent: Nov. 9, 2004

(54) SELF-PROPELLED AQUATIC TOY

(75) Inventor: Wayne Everett Roberts, Kittery, ME (US)

(73) Assignee: Seagoon Boat Building, Kittery, ME (US)

( * ) Notice: Subject to any disclaimer, the term of this patent is extended or adjusted under 35 U.S.C. 154(b) by 0 days.

(21) Appl. No.: 10/354,944

(22) Filed: Jan. 30, 2003

(65) Prior Publication Data

US 2004/0152374 A1 Aug. 5, 2004

(51) Int. Cl.[7] ..... B63H 11/00
(52) U.S. Cl. ..... 440/38; 446/153
(58) Field of Search ..... 440/38, 15; 441/6, 441/10, 11; 446/153, 154, 158, 163, 156, 157; 43/2, 3; 114/121, 312, 315, 332, 333; 472/128, 129

(56) References Cited

U.S. PATENT DOCUMENTS

| | | | | | |
|---|---|---|---|---|---|
| 443,991 | A | * | 1/1891 | Ellis | 472/128 |
| 1,718,637 | A | | 6/1929 | De Pento | |
| 2,801,850 | A | * | 8/1957 | Yount | 472/129 |
| 2,962,283 | A | | 11/1960 | Casey | |
| 3,491,997 | A | | 1/1970 | Winters | |
| D224,361 | S | | 7/1972 | Nelson | |
| 3,751,030 | A | | 8/1973 | Winters | |
| 4,468,546 | A | * | 8/1984 | Jones | 200/84 B |
| 4,756,698 | A | | 7/1988 | Gorg | |
| 4,941,854 | A | | 7/1990 | Takahashi et al. | |
| 4,964,821 | A | | 10/1990 | Tafoya | |
| 4,981,453 | A | * | 1/1991 | Krishan et al. | 441/6 |
| 5,083,948 | A | | 1/1992 | Grobson | |
| 5,171,171 | A | | 12/1992 | Tani | |
| 5,218,366 | A | * | 6/1993 | Cardamone et al. | 441/11 |
| 5,462,460 | A | | 10/1995 | Kobaysahi | |
| 5,601,462 | A | | 2/1997 | Harlow | |
| D408,779 | S | | 4/1999 | Ishigaki | |
| 6,138,604 | A | * | 10/2000 | Anderson et al. | 114/332 |
| 6,311,631 | B1 | | 11/2001 | Beecher | |
| 6,463,690 | B1 | * | 10/2002 | Wood et al. | 43/2 |
| 6,601,333 | B2 | * | 8/2003 | Cicoff et al. | 43/2 |

* cited by examiner

*Primary Examiner*—S. Joseph Morano
*Assistant Examiner*—Lars A Olson
(74) *Attorney, Agent, or Firm*—Pierce Atwood; Kevin Farrell

(57) ABSTRACT

An aquatic toy comprises a hollow, buoyant body having a discharge port formed therein. At least one electrically driven pump is disposed in the body in fluid communication with the discharge port. An electrical power source is also disposed in the body. At least one proximity switch is disposed in the body and connected to the pump and the electrical power source. The proximity switch causes a control circuit between the electrical power source and the pump to close in response to the application of a magnetic field to the proximity switch.

16 Claims, 6 Drawing Sheets

SELF-PROPELLED AQUATIC TOY

BACKGROUND OF THE INVENTION

This invention relates generally to aquatic toys and more particularly to an electrically powered self-propelled aquatic toy.

Various types of self-propelled aquatic toys are available, which are intended to be ridden or to pull a swimmer through the water. Some of these toys are driven by an external propeller which presents a safety hazard if not guarded, especially to children. Other self-propelled toys utilize an internal impeller which is safer. However, the use of an impeller requires that the interior of the toy be formed in the shape of a shroud or chamber around the impeller for efficient operation. This raises the complexity and therefore the cost of the toy. Furthermore, the available aquatic toys require an external switch for starting and stopping the toy which is subject to wear and tear in operation. Accordingly, there is a need for a self-propelled aquatic toy which is simple in construction and which does not have exposed operating controls.

BRIEF SUMMARY OF THE INVENTION

The above-mentioned need is met by the present invention, which provides an aquatic toy comprising a hollow, buoyant body having a discharge port formed therein. At least one electrically driven pump is disposed in the body in fluid communication with the discharge port. An electrical power source is also disposed in the body. At least one proximity switch is disposed in the body and connected to the pump and the electrical power source. The proximity switch causes a control circuit between the electrical power source and the pump to close in response to the application of a magnetic field to the proximity switch.

The present invention and its advantages over the prior art will become apparent upon reading the following detailed description and the appended claims with reference to the accompanying drawings.

BRIEF DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
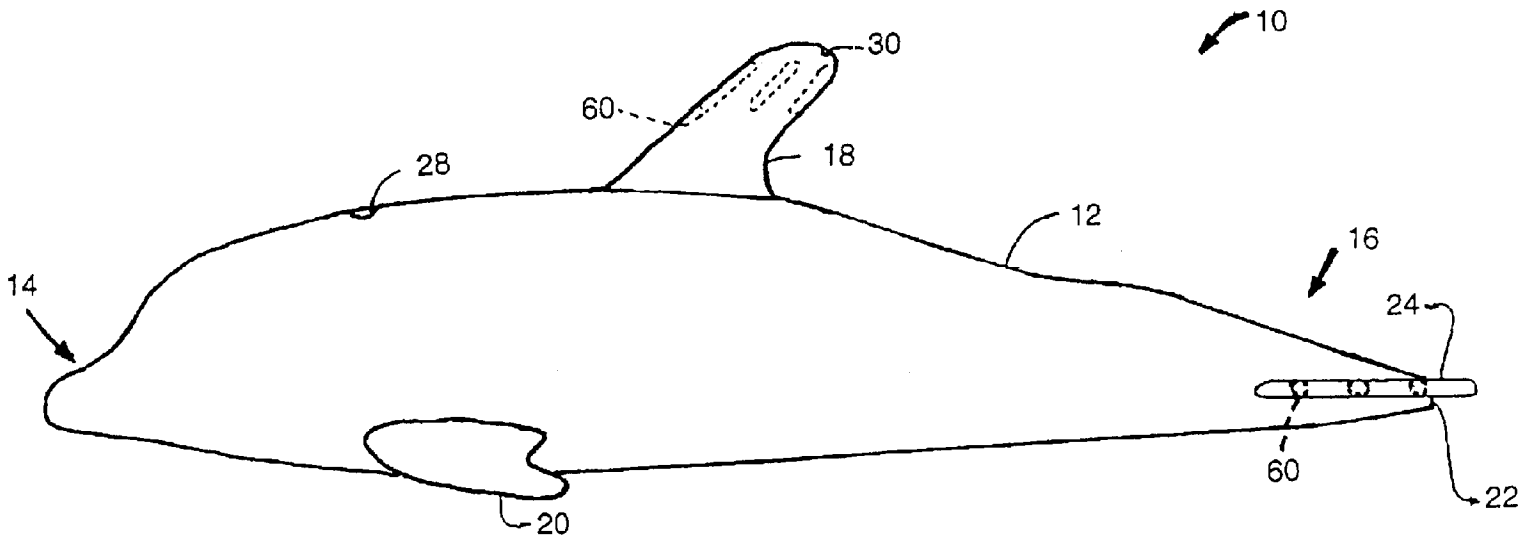
FIG. 1 is a side exterior view of an exemplary self-propelled aquatic toy constructed in accordance with the present invention.
Figure 2:
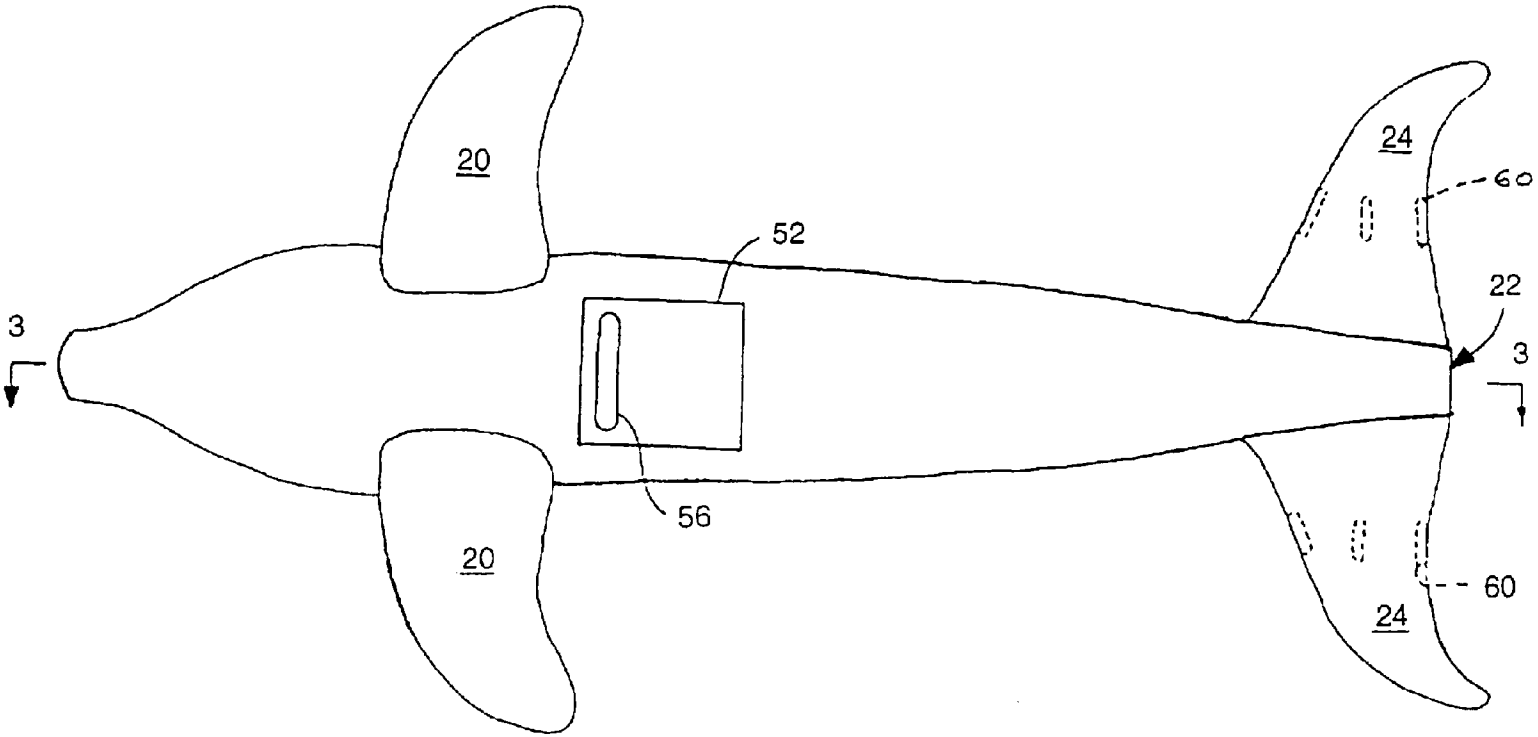
FIG. 2 is a bottom exterior view of the aquatic toy of FIG. 1.

Referring to the drawings wherein identical reference numerals denote the same elements throughout the various views, FIGS. 1 and 2 show an exemplary aquatic toy 10. The toy 10 is suitable for use in a man-made body of water such as a swimming pool, or natural bodies of fresh or salt water. The aquatic toy 10 may be of any desired shape. For example, it could be formed to represent a small whale, a shark or other fish, other marine or land animals, or inanimate objects, for example a boat or a submarine. The particular aquatic toy 10 illustrated is formed in the shape of a dolphin. The toy 10 has a buoyant body 12 which is generally elongated in the direction of travel and has a forward end 14 and an aft end 16. Several appendages extend from the body 12. A dorsal fin 18 extends from the upper surface of the body 12. A pair of flippers 20 extend outwards from the left and right sides of the central portion of the body 12. One or more discharge ports 22 are formed at the aft end 16 of the body 12, and a pair of flukes 24 extend outwards to the left and right of the discharge ports 22.

The body 12 comprises an outer wall 26 surrounding a hollow interior. The body 12 may be made of plastic or any other suitable waterproof material, for example by injection molding or rotational molding. The body 12 may also be formed by applying material (e.g. glass fiber and resin) over a core which is subsequently removed after the material has cured. Water may enter the body 12 through various openings so that it is free-flooding inside. Such openings include a simulated blowhole 28, one or more vents 30 such at the one illustrated at the top of the dorsal fin 18, or through other openings. The toy 10 may be given a slightly positive buoyancy to simulate the attitude of a marine animal in the water, for example by the addition of an appropriate amount of closed-cell foam or other buoyant material to the inside of the body 12, as described in more detail below.

Figure 3:
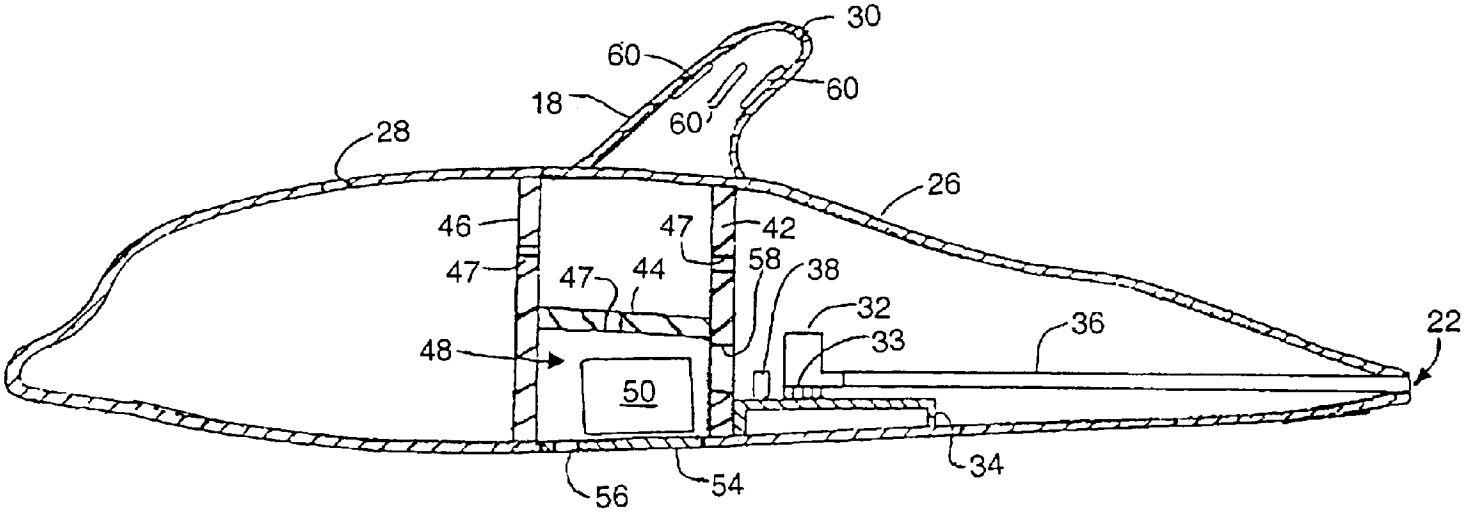
FIG. 3 is a view taken along lines 3—3 of FIG. 2.

FIG. 3 is a schematic cross-sectional view of the interior layout of the toy 10. One or more electrically driven pumps 32 are disposed in the interior of the body 12. In a preferred embodiment, two pumps 32 are used, mounted side by side (only one pump 32 is illustrated in FIG. 3 for clarity). The pumps 32 may be marine bilge pumps of a known type which incorporate a pump driven by an electric motor, and optionally an intake strainer 33 to keep debris out of the pump's moving parts. The pumps 32 are submerged in water inside the free-flooding interior of the body 12. One suitable type of pump is a model 27D 12 volt DC, 1100 GPH bilge pump available from Rule Industries, Gloucester, Mass. 01930 USA. The pumps 32 are mounted to a platform 34 which may be integrally formed as part of the body 12. In the illustrated example, water enters the pump 32 through openings formed around the periphery of the strainer 33. A discharge tube 36 is connected to the outlet port of each pump 32 and extends from the pump 32 to the discharge port 22 at the aft end of the body 12. A load coupler 38 which forms part of a control circuit 40 (described in more detail below) is also mounted to the platform 34.

First, second, and third bulkheads 42, 44, and 46 are disposed in the interior of the body 12. These bulkheads are arranged to divide the interior of the body 12 into sections and also to define a battery compartment 48. The bulkheads may be constructed of closed-cell foam or other buoyant material. The size and shape of the bulkheads may be selected to adjust the buoyancy of the toy 10 to a desired slightly positive value so that the toy 10 floats in a realistic partially-submerged position when placed in the water. One or more holes 47 may be formed through each of the bulkheads 42, 44, and 46 to ensure that water can freely flow within the interior of the body 12.

A electrical power source is disposed in the battery compartment 48. In the illustrated example, a storage type battery 50, for example a lead-acid battery, is used. This may be removed from the battery compartment 48 and recharged when depleted. Any known type of battery which provides sufficient power for the pumps 32 may be used. Other types of electrical power sources, such as a gasoline powered motor-generator set or a fuel cell, could be used instead of a battery if desired.

An opening 52 which communicates with the battery compartment 48 is formed in the bottom surface of the body 12. The opening 52 is covered by an access panel 54 (see FIG. 2). The access panel 54 may be removable, or permanently attached but movable. For example, the access panel 54 could be attached to the body 12 with screws (not shown) in a known manner, or it could be attached to the body 12 with a hinge (also not shown). The access panel 54 may also include a water inlet 56 formed therethrough, to allow water into the interior of the body 12. In the illustrated example, the water flows through this water inlet 56 into the battery compartment 48, past the battery 50 and then through a passage 58 in the first bulkhead 42 into the aft portion of the body 12 and eventually to the pumps 32. This particular arrangement is advantageous in that a relatively long and indirect flow path is provided from the water inlet 56 to the pump inlet, which may prevent a user's appendage or long hair from being drawn in to the pump 32.

Figure 6:
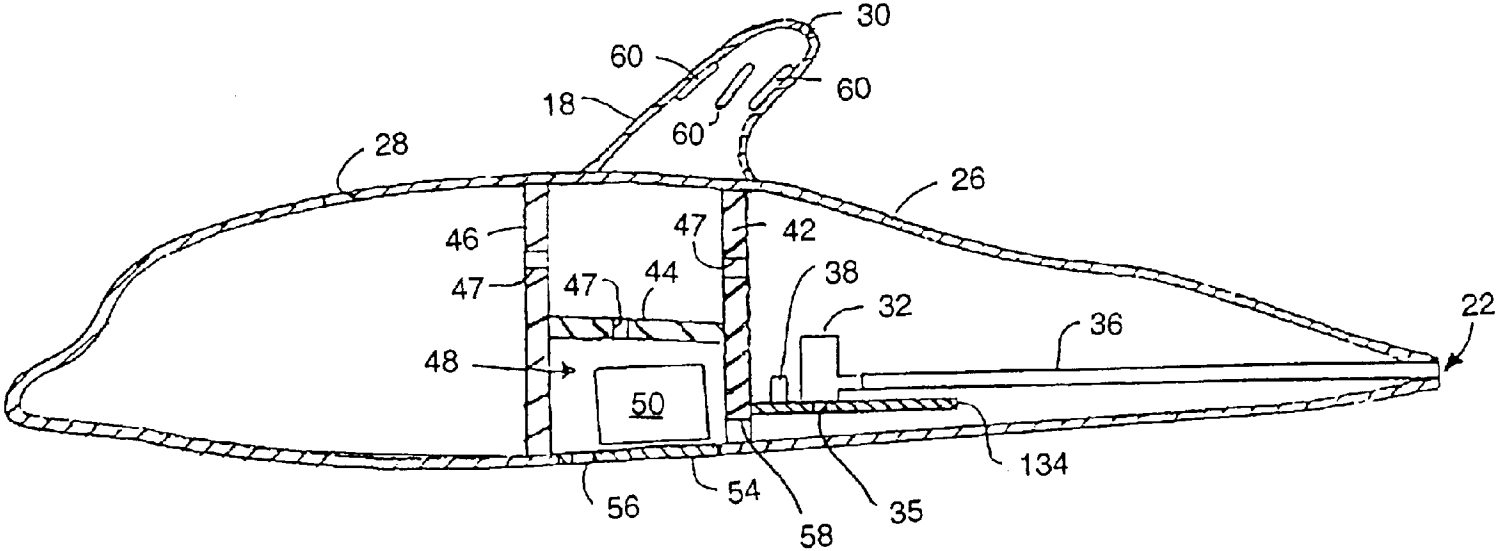
FIG. 6 is a view of an alternative arrangement of the components shown in FIG. 3.

FIG. 6 shows another possible layout of the interior of the toy 10. In this example, the pump 32 is supported on a platform 134 which is attached along its lateral edges to the interior sidewalls of the body 12, so that water may flow freely in the space between the platform 134 and the outer wall 26 of the body 12. The passage 58 is positioned so as to be in communication with this space. This location of the passage 58 provides a more direct flow path of water to the pump 32 in comparison to that shown in FIG. 3, while somewhat increasing the possibility that long hair or the like might become drawn into the pump 32. The pump 32 in this instance is mounted to the platform 134 without the use of a strainer 33. Accordingly, water enters the base of the pump 32 through a hole 35 formed through the platform 134.

The internal arrangement of the body 12 need not be exactly as that shown. Although it is suggested for safety and practical reasons that the pumps 32 and control circuit 40 not be accessible to the user of the aquatic toy 10, the bulkheads may be eliminated if desired, or they may be repositioned so that the pumps 32 and control circuit 40 are accessible to the user.

One or more proximity switches 60 are disposed in the body 12 at various locations. In the example illustrated in FIGS. 1 and 2, three spaced-apart proximity switches 60 are mounted in each of flukes 24 and the dorsal fin 18. The proximity switches 60 may be secured to the body 12 in various ways. For example, they may be embedded in the outer wall 26 of the body 12 during the molding process, or they may be attached to the inner surface of the outer wall 26, for example with epoxy adhesive.

Figure 4:
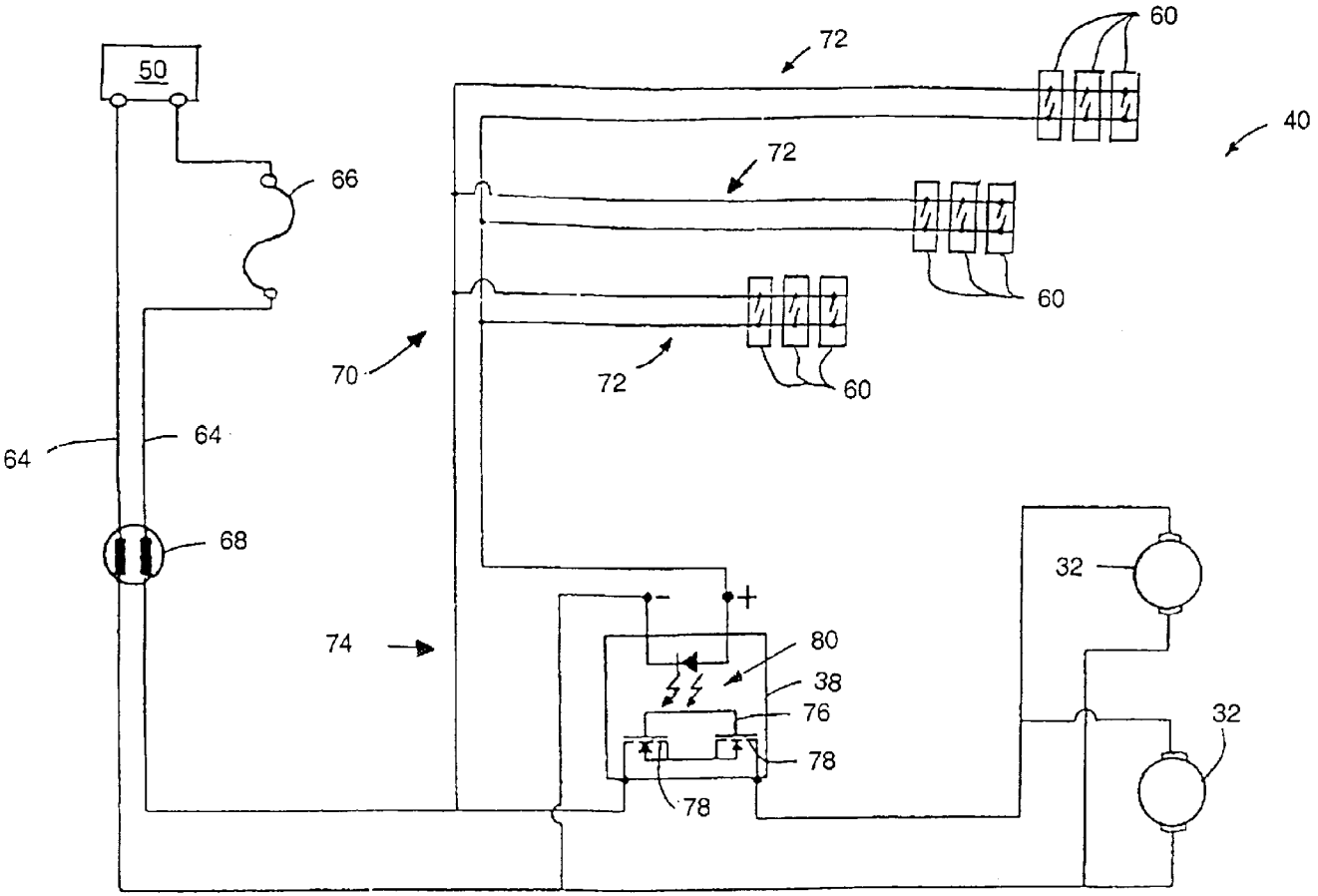
FIG. 4 is an exemplary wiring diagram of a control circuit for use with the present invention.

FIG. 4 is a diagram of an exemplary control circuit 40 for the aquatic toy 10. The primary components of the control circuit 40 are an electrical power source (for example the 12 volt storage battery 50), a load coupler 38, one or more proximity switches 60, and at least one electrically driven pump 32. The components are connected by appropriate wiring. The control circuit 40 is connected through battery leads 64 to the positive and negative terminals of the battery 50, and may include a fuse 66 for overload protection. The battery leads 64 may be joined to the remainder of the control circuit 40 by a two-part connector 68 to allow quick connection and disconnection. A first branch 70 of the control circuit 40 is connected to the proximity switches 60. All of the proximity switches 60 are connected in parallel so that if any one of the proximity switches 60 are closed, a flow path will be formed from the battery positive lead through a low-current or control side of the load coupler 38 and back through the battery ground lead. If multiple proximity switches 60 are used, the first branch 70 of the control circuit may be divided into multiple legs 72, each leg 72 containing at least one proximity switch 60.

Each proximity switch 60 is a type which is actuated (that is, closed) by the presence of a nearby magnetic field (for example, the field from a magnetic wristband, described below). The proximity switches 60 may be 60 Watt, 400 volt reed switches available from BareReeds.com, Racine, Wis., 53408 USA. The proximity switches 60 may be connected to the control circuit 40 in parallel with a varistor or other overload protection device in a known manner in order to prevent deterioration and premature wear of the proximity switches 60.

A second branch 74 of the control circuit connects the battery 50 to the pumps 32 through the high-current side of the load coupler 38. In the illustrated example, the load coupler 38 is a relay of a known type having a movable core 76 which makes or breaks a connection across a set of main contacts 78 depending upon its position. When one or more of the proximity switches 60 are closed as described above, an electromagnetic coil 80 moves the core 76 so that it bridges the main contacts 78, thus closing the second branch 74 of the control circuit and powering the pumps 32. Although the present example describes an electromechanical relay, the load coupler 38 may be any known type of device operable to close the control circuit 40 in response to the closing of the proximity switches 60. In the present example the load coupler 38 is encapsulated or "potted" in a suitable compound to protect it from water. The load coupler 38 could also be installed in a waterproof case in lieu of encapsulation.

Figure 5:
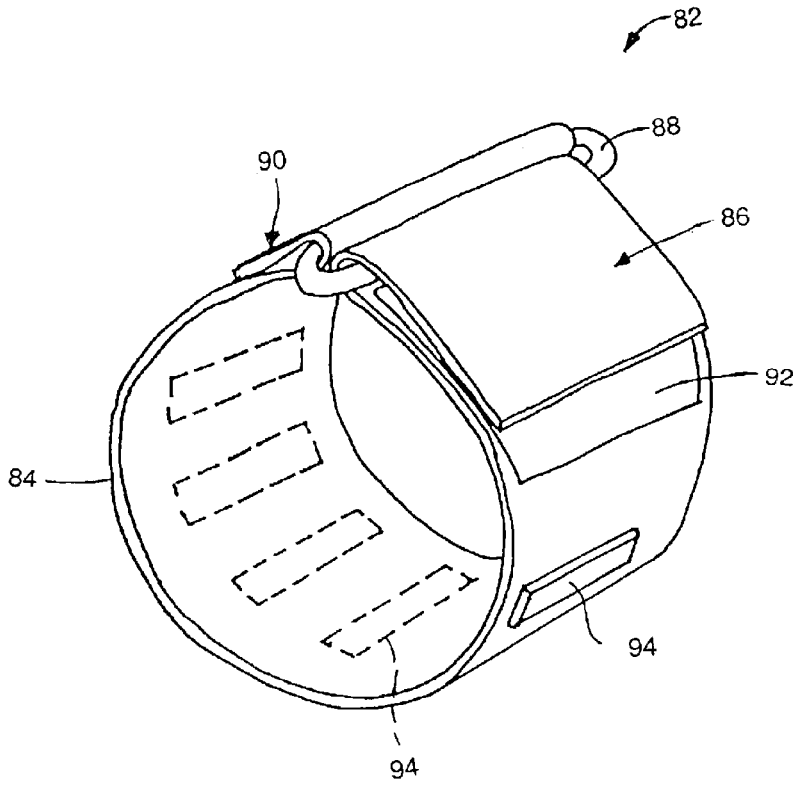
FIG. 5 is a schematic view of a magnetic wrist band for use with the present invention.

FIG. 5 shows an exemplary magnetic wristband 82 for use with the present invention. The illustrated wristband 82 comprises a strap 84 of fabric material. A first end 86 of the strap 84 is threaded through a metal ring 88 attached to a second end 90 of the strap 84. The first end of the strap 84 is then folded back upon itself and secured with a hook and loop fastening material 92 of a known type. This fastening arrangement allows the circumference of the wristband 82 to be adjusted for various users. For example, a child or an adult may use the same wristband 82. One or more permanent magnets 94 are attached to the wristband 82 in a known manner. For example, the magnets 94 may be glued or sewn to the exterior of the wristband 82, or the wristband 82 may be constructed of two or more layers of material and the magnets 94 placed between the layers. The size, shape, and number of magnets 94 are selected in conjunction with the proximity switch sensitivity to reliably operate the proximity switches at a desired range. For example, the magnets 94 may be selected to close the proximity switches 60 when the wristband is placed directly on the surface of the body 12. The wristband 82 need not be of the exact type described. Any arrangement which allows secure attachment to a user's wrist and holds the required number and size of magnets 94 may be used. Alternatively, the required magnets 94 may be contained in other articles of clothing, examples of which include a belt, a swimsuit, or a necklace.

In operation, the battery 50 is charged and installed in the battery compartment 48, and electrically connected to the control circuit 40. A user then puts on the wristband 82 and grasps or lies upon the toy 10 in such a manner that the wristband 82 is near one of the proximity switches 60, for example by placing his or her wrist in contact with one of the toy's flukes 24 or its dorsal fin 18. The use of multiple proximity switches 60 as described above allows a user to activate the pumps 32 by placing his or her wrist on the toy 10 in varied locations and provides a backup should one of the proximity switches 60 fail. Furthermore, because each proximity switch 60 has a limited sensing range, the placement of several switches in a single area (e.g. the dorsal fin 18) increases the probability that at least one proximity switch 60 will be closed when the user places his or her wrist on or near that general area of the toy 10, without requiring an exact placement of the user's wrist.

This actuation of one or more of proximity switches 60 causes the circuit from the battery 50 to the pumps 32 to be closed, as described above. The pumps 32 draw in water from the interior of the body 12 (which has entered the body 12 through the blowhole 28 or water inlet 56, for example) and forcefully expel it out the discharge tubes 36 and the discharge ports 22, causing the aquatic toy 10 to be propelled forward, pulling the user with it. The toy 10 may be steered left or right, or caused to dive or breach the water's surface by manipulations of the user's body. If the user should remove his or her wrist from the toy 10, either intentionally or by accidentally letting go or falling off of the aquatic toy 10, the control circuit 40 will open and the toy 10 will come to a stop.

While specific embodiments of the present invention have been described, it will be apparent to those skilled in the art that various modifications thereto can be made without departing from the spirit and scope of the invention as defined in the appended claims.

What is claimed is:

1. An aquatic toy, comprising:

a hollow, buoyant body having a discharge port formed therein;

at least one electrically driven pump disposed in said body in fluid communication with said discharge port;

an electrical power source disposed in said body;

a control circuit connected between said electrical power source and said pump; and at least one proximity switch disposed in said body, wherein said control circuit closes when said proximity switch is closed.

2. The aquatic toy of claim 1 wherein said electrical power source is a storage battery.

3. The aquatic toy of claim 1 wherein said control circuit comprises a relay.

4. The aquatic toy of claim 1 wherein said buoyant body is formed in the shape of an animal and includes at least one appendage, and wherein said proximity switch is disposed in said appendage.

5. The aquatic toy of claim 4 wherein said animal is a dolphin.

6. The aquatic toy of claim 1 further comprising additional proximity switches disposed in said body, all of said proximity switches being connected in a parallel circuit arrangement such that the closing of any one of said proximity switches causes said control circuit to close.

7. The aquatic toy of claim 1 where said pump is a marine bilge pump.

8. The aquatic toy of claim 1 wherein said proximity switch is a reed switch which closes in response to the presence of a magnetic field.

9. An aquatic toy, comprising:

a hollow, buoyant body having a free-flooding interior and a discharge port formed therein;

an electrical power source disposed in said body;

at least one electrically driven bilge pump disposed in said free-flooding interior of said body, said bilge pump being connected to said discharge port by a discharge tube;

a control circuit connected between said electrical power source and said bilge pump for delivering electrical current from said electrical power source to said bilge pump; and at least one proximity switch disposed in said body, said proximity switch being connected to said control circuit such that the closing of said proximity switch causes said control circuit to close.

10. The aquatic toy of claim 9 wherein said electrical power source is a storage battery.

11. The aquatic toy of claim 9 wherein said control circuit comprises a relay.

12. The aquatic toy of claim 9 wherein said proximity switch closes in response to the presence of a magnetic field.

13. The aquatic toy of claim 9 wherein said buoyant body is formed in the shape of an animal and includes at least one appendage, and wherein said proximity switch is disposed in said appendage.

14. The aquatic toy of claim 13 wherein said animal is a dolphin.

15. The aquatic toy of claim 9 further comprising additional proximity switches disposed in said body, all of said proximity switches being connected in a parallel circuit arrangement such that the closing of any one of said proximity switches causes said control circuit to close.

16. The aquatic toy of claim 9 wherein said proximity switch is a reed switch which closes in response to the presence of a magnetic field.

* * * * *